US009992582B2

(12) United States Patent
Jensen et al.

(10) Patent No.: US 9,992,582 B2
(45) **Date of Patent: *Jun. 5, 2018**

(54) METHOD OF OPERATING A HEARING AID SYSTEM AND A HEARING AID SYSTEM

(71) Applicant: Widex A/S, Lynge (DK)

(72) Inventors: Lars Baekgaard Jensen, Farum (DK); Joe Jensen, Copenhagen (DK); Christian Christiansen Burger, Holte (DK)

(73) Assignee: Widex A/S, Lynge (DK)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/489,259

(22) Filed: Apr. 17, 2017

(65) Prior Publication Data

US 2017/0223467 A1 Aug. 3, 2017

Related U.S. Application Data

(63) Continuation-in-part of application No. PCT/EP2014/072092, filed on Oct. 15, 2014.

(51) Int. Cl.
*H04R 25/00* (2006.01)

(52) U.S. Cl.
CPC ..... *H04R 25/305* (2013.01); *H04R 25/353* (2013.01); *H04R 25/356* (2013.01)

(58) Field of Classification Search
CPC ... H04R 25/305; H04R 25/353; H04R 25/356
USPC ..... 381/60
See application file for complete search history.

(56) References Cited

U.S. PATENT DOCUMENTS

| | | | | |
|---|---|---|---|---|
| 6,405,164 | B1 * | 6/2002 | Pinai | H03G 1/0088 381/23.1 |
| 7,447,319 | B2 * | 11/2008 | Miller | H04R 25/30 381/60 |
| 2005/0105741 | A1 * | 5/2005 | Niederdrank | H04R 25/70 381/60 |
| 2009/0052706 | A1 * | 2/2009 | Gottschalk | H04R 25/305 381/314 |
| 2010/0111315 | A1 * | 5/2010 | Kroman | H04R 25/305 381/60 |
| 2010/0166198 | A1 * | 7/2010 | Perman | H04R 25/453 381/60 |
| 2010/0272272 | A1 * | 10/2010 | Muller | H04R 25/305 381/60 |

(Continued)

FOREIGN PATENT DOCUMENTS

| | | |
|---|---|---|
| EP | 2 177 052 B1 | 4/2010 |
| EP | 2 453 669 A1 | 5/2012 |

OTHER PUBLICATIONS

International Search Report dated Jul. 7, 2015 in Application No. PCT/EP2014/072092.

(Continued)

*Primary Examiner* — David Ton
(74) *Attorney, Agent, or Firm* — Sughrue Mion, PLLC

(57) ABSTRACT

A hearing aid system and method of operating the hearing aid system, wherein the impedance of a hearing aid receiver is measured, the measured impedance is used to determine non-linearity characteristics of the receiver, and upon detecting that the non-linearity exceeds a threshold, the user is alerted and/or the receiver non-linearity is compensated.

14 Claims, 5 Drawing Sheets

(56) References Cited

U.S. PATENT DOCUMENTS

| | | | | |
|---|---|---|---|---|
| 2013/0272532 | A1* | 10/2013 | Mazanec | H04R 25/305 381/60 |
| 2015/0271609 | A1* | 9/2015 | Puria | H04R 25/456 381/328 |

OTHER PUBLICATIONS

"IEC 62458", Jan. 31, 2010, pp. 1-23, XP055065012, Geneva, Switzerland Retrieved from the Internet: URL:https://webstore.iec.ch/preview/info_iec62458%7Bed1.0%7Den.pdf [retrieved on Jun. 3, 2013].

Written Opinion dated Jul. 7, 2015 in Application No. PCT/EP2014/072092.

* cited by examiner

METHOD OF OPERATING A HEARING AID SYSTEM AND A HEARING AID SYSTEM

CROSS REFERENCE TO RELATED APPLICATIONS

This is a continuation-in-part of International Application No. PCT/EP2014/072092 filed Oct. 15, 2014. This application is related to concurrently filed application identified by Ser. No. 15/489,270 which is a continuation-in-part of International Application No. PCT/EP2014/072087 filed Oct. 15, 2014. The entire disclosures of all of the above-referenced applications are hereby incorporated by reference.

BACKGROUND OF THE INVENTION

The present invention relates to a method of operating a hearing aid system. The present invention also relates to a hearing aid system adapted to operate according to said method.

Generally a hearing aid system according to the invention is understood as meaning any system which provides an output signal that can be perceived as an acoustic signal by a user or contributes to providing such an output signal and which has means which are used to compensate for an individual hearing loss of the user or contribute to compensating for the hearing loss of the user or contribute to compensating for the hearing loss. These systems may comprise hearing aids which can be worn on the body or on the head, in particular on or in the ear, and can be fully or partially implanted. However, devices like consumer electronic devices (televisions, hi-fi systems, mobile phones, MP3 players etc.), whose main aim is not to compensate for a hearing loss, may also be considered a hearing aid system, provided they have measures for compensating for an individual hearing loss.

Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit.

In a traditional hearing aid fitting, the hearing aid user visits an office of a hearing aid fitter, and the user's hearing aids are adjusted using the fitting equipment that the hearing aid fitter has in his office. Typically the fitting equipment comprises a computer capable of executing the relevant hearing aid programming software and a programming device adapted to provide a link between the computer and the hearing aid.

Within the present context a hearing aid can be understood as a small, battery-powered, microelectronic device designed to be worn behind or in the human ear by a hearing-impaired user. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

The mechanical design of hearing aids has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit, and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with other devices of the hearing aid system. Thus within the present context the term "hearing aid system device" may denote a hearing aid or an external device.

The inventors have realized that it is an important issue for hearing aid systems that the performance of the microphones and receivers, may degrade due to normal aging, especially when the hearing aid system is worn in an environment with high humidity or when combined with significant exposure to water or sweat. The performance may also degrade due to rough handling, e.g. resulting from e.g. a hearing aid being dropped by the user. Furthermore, receiver distortion may vary greatly from one unit to the other due to the nature of the design. Reduced performance of the hearing aid system may have the consequence that the hearing aid system is not worn by a user or that a user having the hearing aid system on trial selects not to purchase it.

EP-B1-2177052 discloses a method of identifying a receiver in a hearing aid comprising the steps of measuring the impedance of the receiver using said hearing aid and identifying said receiver as one of several predetermined receiver models on basis of said impedance measurement.

EP-B1-2039216 discloses a method for monitoring a hearing device comprising an electro-acoustical output transducer worn at or in a user's ear or in a user's ear canal, wherein the electrical impedance of the output transducer is measured and analyzed, whereby the status of the output transducer and/or of an acoustical system cooperating with the output transducer, such as a tubing of a BTE hearing device, may be evaluated in a simple and efficient manner. Thereby it is enabled to automatically and immediately recognize when the output transducer or an acoustical system cooperating with the output transducer is blocked by ear wax or when the output transducer is damaged.

More specifically EP-B1-2039216 discloses that the measured electrical impedance as a function of frequency may be analyzed by comparing the measured electrical impedance to reference data stored in the hearing device, wherein such reference data may be generated in the manufacturing process of the hearing device.

According to one embodiment of EP-B1-2039216 the resonance frequency of the loudspeaker in free space is stored in a hearing device during the manufacturing process. Later, when the hearing device is operated, an analyzer unit generates the stored resonance frequency and measures the voltage on a resistor related to the loudspeaker at this frequency. If the measurement shows too much of a difference, an alarm signal is created.

U.S. Pat. No. 7,302,069 discloses a method wherein the acoustic conditions in the auditory canal, especially the acoustic impedance, are estimated by measuring the electrical input impedance of a hearing aid earpiece and wherein a mechanical resonance may be determined from the graph of the electrical input impedance and whereby a detected shift of the mechanical resonance can then be used for automatic correction of the normal frequency curve of the hearing aid.

However, none of the prior art is directed at detecting or compensating reduced hearing aid system performance due to non-linear effects in the receiver.

It is therefore a feature of the present invention to provide a method of operating a hearing aid system that assists the user in taking appropriate action in case of excessive receiver distortion.

It is another feature of the present invention to provide a method for preventing continuous use of a hearing aid receiver with degraded performance due to receiver distortion.

It is another feature of the present invention to provide a hearing aid system adapted to improve the hearing aid system user's ability to take appropriate action in case of excessive receiver distortion.

SUMMARY OF THE INVENTION

The invention, in a first aspect, provides a method of operating a hearing aid system comprising the steps of:

measuring the electrical impedance of a hearing aid receiver for a given frequency and for a range of different bias voltages applied to the hearing aid receiver, deriving values of a non-linear hearing aid receiver parameter for the range of different bias voltages, using the derived values of the non-linear hearing aid receiver parameter to estimate a measure of the non-linearity of the hearing aid receiver, and triggering an action directed at alerting a hearing aid system user or directed at compensating the non-linearity of the hearing aid receiver if the estimated measure of the non-linearity exceeds a predetermined threshold.

This provides a method adapted to assist a hearing aid system user in taking appropriate action in case of excessive receiver distortion.

The invention, in a second aspect, provides a hearing aid system comprising:

a signal generator adapted to provide a test signal to a receiver of the hearing aid system, wherein the test signal consists of a small signal part and a DC bias voltage, a signal detector adapted to determine the value of a signal representing the receiver impedance, in response to a given test signal, a hearing aid receiver parameter estimator adapted to determine the non-linear behavior of a non-linear hearing aid receiver parameter, and a trigger adapted to determine whether the non-linearity of the hearing aid receiver has exceeded a predetermined threshold based on the determined non-linear behavior of a non-linear hearing aid receiver parameter and adapted to trigger an action directed at alerting a hearing aid system user or hearing care professional or directed at compensating the non-linearity of the hearing aid receiver.

This provides an improved a hearing aid system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
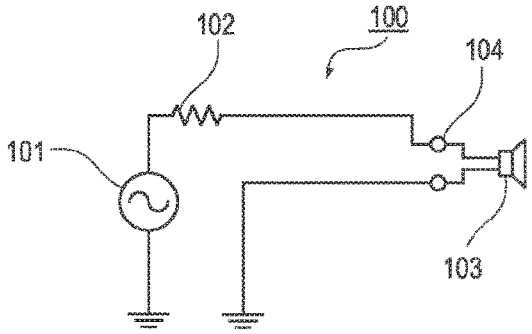
FIG. 1 illustrates highly schematically a basic circuitry for measuring the electrical impedance of an electroacoustic output transducer.

Within the present context the term "bias voltage" is to be interpreted as a DC voltage that is applied across an electronic device to set an operating condition.

Within the present context the term "receiver distortion" may be used interchangeably with the term "receiver non-linearity" since the distortion of the sound provided by a hearing aid receiver (and the correspondingly degraded sound quality) is typically the result of non-linear effects in the hearing aid receiver.

Within the present context the generally applied term "receiver impedance" may be used interchangeably with the more precise term "magnitude of the receiver impedance".

The inventors have found that a significant number of hearing aid system receivers may suffer from degraded sound quality, e.g. if they have been dropped by the user, and that appropriate action in response hereto is therefore required. Such action can e.g. be based on alerting the hearing aid system user or based on active compensation of the degraded receiver performance.

Especially the inventors have found that so called balanced armature receivers that are widely used in hearing aid systems may be quite sensitive to rough handling, such as dropping a hearing aid, since this may cause the armature to be physically deformed or displaced from its optimum position in the air gap between the magnets of the balanced armature receiver whereby additional distortion and degraded sound quality may result.

However, the present invention is not limited to use in hearing aid systems with a balanced armature receiver. The methods and systems according to the invention may as well be used in connection with other receiver topologies such as moving coil receivers.

Furthermore the inventors have found that a low complexity measurement of short duration can provide the necessary foundation for estimating the receiver distortion and hereby whether further action is required. Specifically the inventors have found that a significantly more precise estimation of the receiver distortion may be achieved by measuring the electrical receiver impedance for a number of different values of a bias voltage applied to the receiver. Especially the inventors have found that the estimation can be further improved by applying both positive and negative values of the bias voltage, because this allows the symmetry of the non-linear receiver parameters to be evaluated.

Yet further the inventors have found that the present invention may allow less expensive receivers with a larger initial distortion to be used since the distortion can be at least partly compensated.

Generally the prior art is limited in so far that it does not consider the output transducer performance at various signal levels, especially high output levels where output transducer distortion may be an issue.

EP-B1-2039216 is limited in scope at least in so far that it only measures the electrical receiver impedance for one output level at zero bias.

U.S. Pat. No. 7,302,069 is limited in that only a shift of a resonance frequency is used as basis for a compensation, which makes sense since the patent is directed at compensating changes in the acoustical impedance, i.e. primarily changes in the characteristics of the ear canal residual volume.

Reference is first made to FIG. 1, which illustrates highly schematically a basic circuitry 100 for measuring the electrical impedance of an electroacoustic output transducer 103. The basic circuitry 100 comprises a sinus (i.e., sine wave) generator 101, a reference resistor 102, the electroacoustic output transducer 103 (that in the following may be denoted loudspeaker or receiver) and a first measurement point 104.

The basic circuitry 100 can provide a measurement of the receiver impedance as a function of frequency by using the sinus generator 101, with a known voltage, to make a frequency sweep while measuring the voltage at the first measurement point 104. However, the circuitry of FIG. 1 can only be used for measuring the receiver impedance at the DC operating point.

Figure 2:
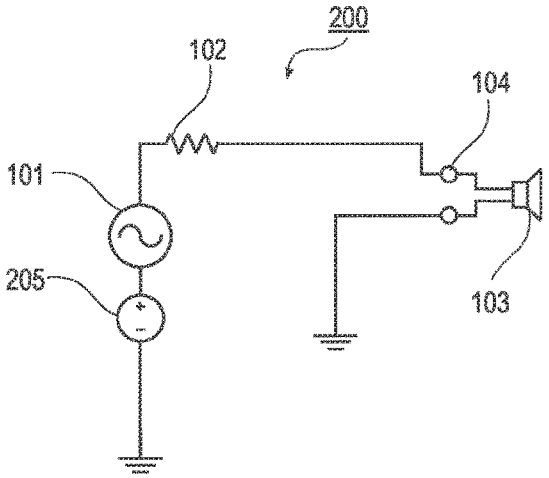
FIG. 2 illustrates highly schematically a circuitry for measuring the electrical impedance of an electroacoustic output transducer according to an embodiment of the invention.

Reference is therefore now made to FIG. 2, which illustrates highly schematically a circuitry 200 for measuring the electrical impedance of an electroacoustic output transducer 103 according to an embodiment of the invention. The circuitry 200 comprises the same components as the basic circuitry of FIG. 1 except for the addition of a direct current (DC) voltage supply 205 that is adapted to provide an adjustable DC bias voltage whereby the receiver impedance can be measured for operating points that are shifted away from the DC operating point.

Considering FIG. 2 it follows directly that the voltage $V_{aux}$ at the measurement point 104 for a zero DC voltage supply (bias voltage) is given as:

$$V_{aux} = V_{signal} \times \frac{Z_{receiver}}{(Z_{receiver} + R_{ref})}$$

wherein $V_{signal}$ is the AC voltage supplied by the sinus generator 101. $Z_{receiver}$ is the receiver impedance to be determined, and $R_{ref}$ is the resistance of the reference resistor 102.

In order to optimize the sensitivity of the measured voltage with respect to changes in the receiver impedance the voltage $V_{aux}$ is differentiated with respect to the receiver impedance whereby a measure for the sensitivity is found and whereby the sensitivity can be optimized by differentiating with respect to the resistance of the reference resistor and finding an optimum by setting the expression for the differentiated sensitivity equal to zero:

$$V_{sensitivity} = \frac{dV_{aux}}{dZ_{receiver}} = V_{signal} \times \frac{R_{ref}}{(Z_{receiver} + R_{ref})^2}$$

$$\frac{dV_{sensitivity}}{dR_{ref}} = V_{signal} \times \frac{(Z_{receiver} + R_{ref}) - 2R_{ref}}{(Z_{receiver} + R_{ref})^3}$$

$$\frac{dV_{sensitivity}}{dR_{ref}} = 0 \xrightarrow{yields} Z_{receiver} = R_{ref}$$

Based on this the resistance of the reference resistor 102 is preferably selected to be in the range of 1-2 times the resistance of the receiver impedance in order to optimize the sensitivity of the measured voltage with respect to changes in the receiver impedance while at the same time keeping in mind that the magnitude of the receiver impedance over the range of audible frequencies is generally somewhat larger than the receiver resistance and while at the same time also keeping the resistance of the reference resistor 102 so small that it is possible to apply a DC bias voltage over the receiver that is similar to the drive voltage applied over the receiver, during normal operation, where the reference resistor is coupled out from the main signal part between the input and output transducers, and where the output level from the receiver is close to its maximum.

The impedance of receivers, suitable for use in hearing aid systems, may be in the range of 10-1000 ohm and consequently the resistance of the reference resistor is selected to be in the range of 10-2000 ohm. However, according to a variation of the present embodiment the basic circuitry 200 is adapted such that a switching circuit allows the value of the reference resistor 102 to be changed in case a measurement of $V_{aux}$ shows that the resistance of the reference resistor 102 is too far from the magnitude of the receiver impedance. This can be determined since the magnitude of $V_{aux}$ will be equal to half the magnitude of $V_{signal}$ when the magnitude of the receiver impedance $Z_{receiver}$ equals the resistance of the reference resistor $R_{ref}$. As one example a first reference resistor 102 with a resistance of 200 ohm is used initially, and in case the magnitude of $V_{aux}$ drops below 30% of the magnitude of $V_{signal}$ then the first reference resistor is switched out and a second reference resistor with a resistance of say 1000 ohm is switched in, and by having this specific combination of resistance values for the reference resistor then the magnitude of $V_{aux}$ will stay in the range of 30-70% of the magnitude of $V_{signal}$ for receiver impedance values in the range between say 100-2000 ohm.

According to further variations the resistance values of the two reference resistors are in the range of 50-250 and 1000-3000 ohms respectively.

However, the circuitry of FIG. 2 is limited in so far that the available DC voltage in most hearing aids is limited to only positive voltages between zero and the battery voltage. This is disadvantageous because some important hearing aid receiver defects may be detected as a receiver impedance that is asymmetrical as a function of the sign of the DC bias voltage.

Figure 3:
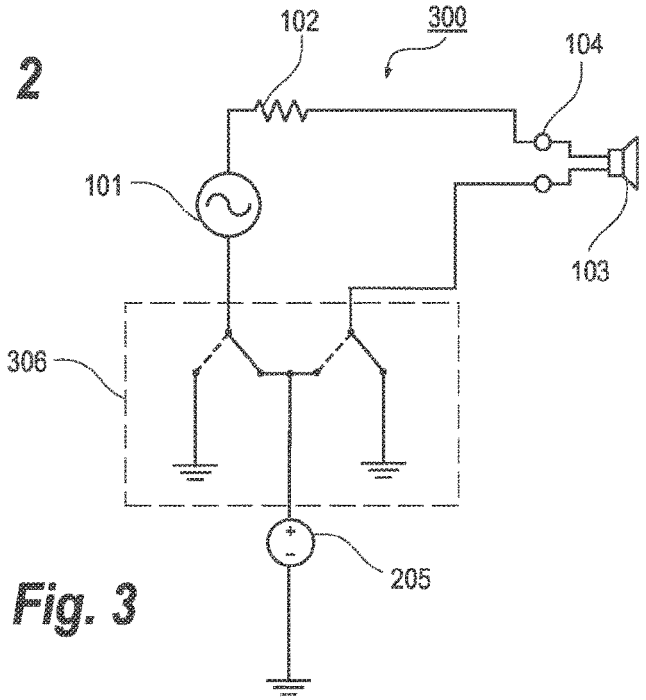
FIG. 3 illustrates highly schematically a circuitry for measuring the electrical impedance of an electroacoustic output transducer according to an embodiment of the invention.

Reference is therefore now made to FIG. 3, which illustrates highly schematically a circuitry 300 for measuring the electrical impedance of an electroacoustic output transducer 103 according to an embodiment of the invention. The circuitry 300 comprises the same components as the circuitry of FIG. 2 except for the addition of a switching circuit 306 that is inserted between the DC voltage supply 205 and the sinus generator 101 and the hearing aid output transducer 103, whereby both a positive and a negative DC bias voltage can be applied by providing the positive voltage of the DC voltage supply 205 to either the positive or the negative terminal of the hearing aid output transducer 103. In FIG. 3 the positive voltage of the DC voltage supply 205 is supplied to the sinus generator 101 while the hearing aid output transducer 205 is connected to ground. The dashed lines of the switching circuit 306 illustrates how the positive voltage of the DC voltage supply may be connected directly to the hearing aid output transducer 205 while the sinus generator 101 is connected to ground.

Figure 4:
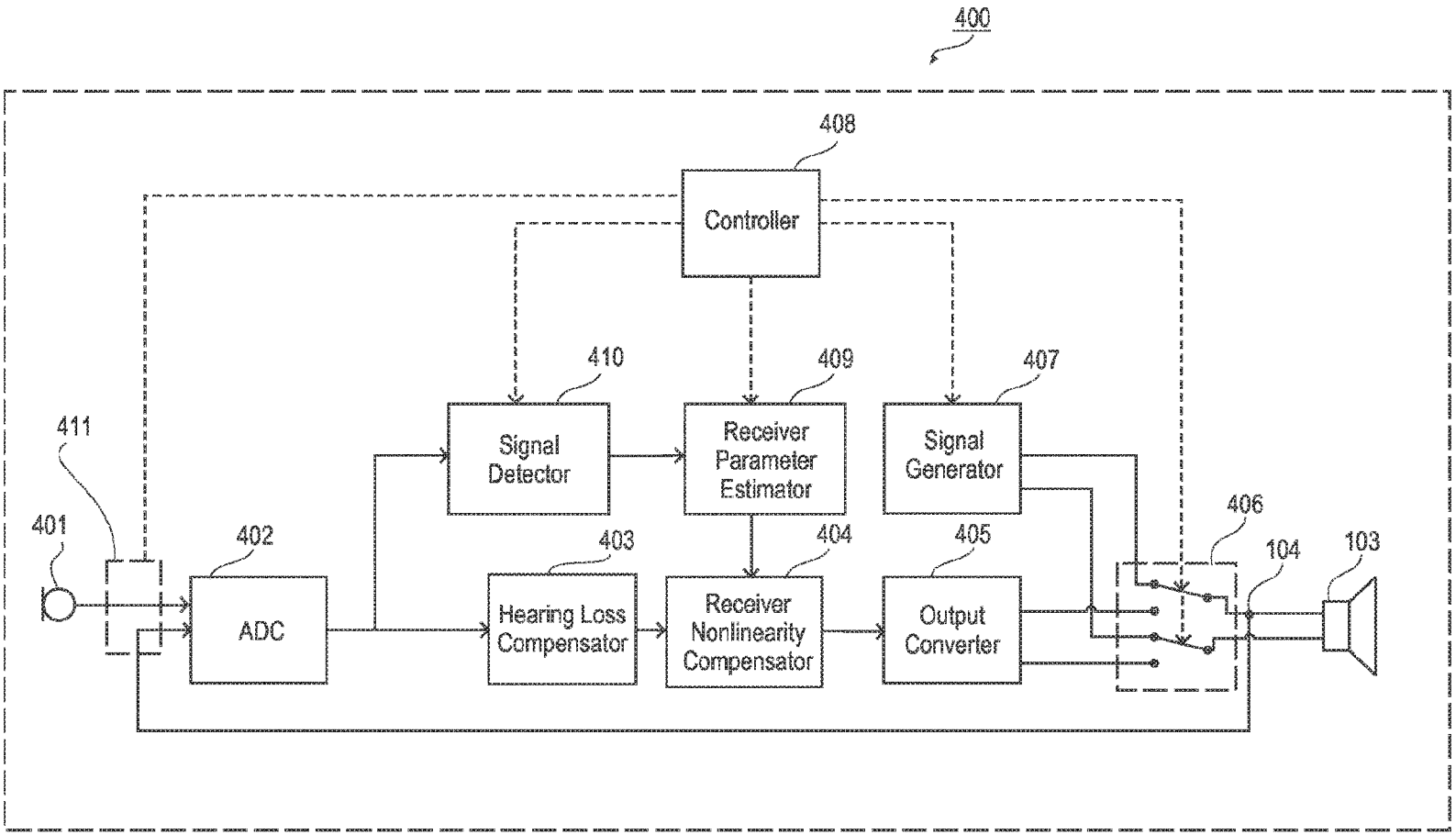
FIG. 4 illustrates highly schematically a hearing aid according to an embodiment of the invention.

Reference is now made to FIG. 4, which illustrates highly schematically a hearing aid 400 according to an embodiment of the invention.

The hearing aid 400 comprises an input acoustical-electrical transducer 401, an analog-digital converter (ADC) 402, a hearing loss compensator 403 adapted for alleviating a hearing deficit of an individual hearing aid user, a receiver non-linearity compensator 404, an output converter 405, an output switching circuit 406, a signal generator 407, a controller 408, a receiver parameter estimator 409, a signal detector 410, an input switching circuit 411, a first measurement point 104 and an electroacoustic output transducer 103.

According to the present embodiment the hearing aid 400 is adapted such that it can switch between being in a normal operation mode and being in a receiver measurement mode.

According to the present embodiment the hearing aid mode of operation may be selected directly using an interface in an external device, such as a remote control or a smart phone, or using a selector accommodated in a hearing aid. In a variation of the present embodiment the hearing aid system may be set up to enter the receiver measurement mode automatically with some predefined interval or in response to detecting some specific sound environment, such as silence or in response to a predetermined trigger event such as every time the hearing aid system is powered up. The option where the user is capable of directly selecting the measurement mode is advantageous in that it allows the user to investigate immediately whether the receiver is malfunctioning. However, the option where the receiver measurement mode is entered automatically with regular intervals may be advantageous in that it may avoid that the user perceives a malfunctioning receiver because degraded receiver performance can be compensated automatically in response to the receiver measurements.

In variations of the present embodiment an alert is issued if an estimated measure of the receiver non-linearity exceeds a predetermined threshold. The alert may be an acoustic alert provided by a hearing aid or an external device of the hearing aid system. Additionally or alternatively the alert may comprise the transmission of data illustrating the receiver non-linearity to an external device of the hearing aid system for visual display by the external device and may also comprise further transmission of the data from the external device and to a hearing aid fitter or hearing aid manufacturer. According to yet another variation the data illustrating the receiver non-linearity are stored in a log accommodated either in a hearing aid or an external device of the hearing aid system.

According to one variation the measure of the non-linearity is the maximum extent of a range of bias voltage levels, within which range the electrical impedance of the hearing aid receiver at the resonance frequency deviates less than a predetermined value.

According to another variation the measure of the non-linearity is the extent of a symmetric range of positive and negative bias voltage levels within which symmetric range the electrical impedance of the hearing aid receiver at said resonance frequency deviates less than a predetermined value.

According to still further variations the measure of the non-linearity is the deviation of the electrical impedance of the hearing aid receiver, at said resonance frequency, measured at a predetermined non-zero bias voltage relative to the electrical impedance of the hearing aid receiver, at said resonance frequency, measured at zero bias voltage.

According to yet further variations the measures of the non-linearity are defined based on measurements of the electrical impedance of the hearing aid receiver at a frequency above the resonance frequency, whereby the measure of the non-linearity is primarily governed by the non-linear electrical inductance instead of by the non-linear force factor.

When the receiver measurement mode is selected, the controller 408 is activated and initiates the measurements. This comprises the steps of controlling the signal generator 407, the output switching circuit 406, the input switching circuit 411, the signal detector 410 and the receiver parameter estimator 409.

In FIG. 4 the output switching circuit 406 is set in the position where the hearing aid 400 is in receiver measurement mode. The signal generator 407 applies a measurement signal to the output transducer 103 in the manner disclosed in the embodiment of FIG. 3. The voltage at the first measurement point 104 is fed to the ADC 402 through the interaction of the input switching circuit 411, which is controlled by the controller 408, and that allows the signal from the first measurement point 104 to be input to the ADC 402 instead of the signal from the input transducer 401. It is a specific advantage of the present embodiment that only a single ADC is required despite that the hearing aid may be in two different modes of operation. It should be obvious to those skilled in the art that switching of the input signals could just as well be implemented after the ADC. This would require one ADC per input signal and a subsequent switching between the signals in the digital domain.

It is a further advantage that the ADC 402 in both modes of operation outputs a digital signal wherein the DC part of the input signal to the ADC is removed because this allows the same digital signal processing to be applied independent on whether a positive or negative bias voltage has been applied by the signal generator 407. According to the present embodiment the DC part of the input signal to the ADC 402 is removed using a high pass filter up-stream of the ADC 402.

Thus when the hearing aid is in normal operation mode the output switching circuit 406 provides that the sinus generator 101 (which may also be denoted small signal generator), the reference resistor 102, the DC voltage supply 205 and the switching circuit 306 is not part of the main signal path in the hearing aid 400.

Considering FIG. 3 again it follows directly that the voltage $V_{aux}$ at the first measurement point may be expressed as:

$$V_{aux} = (V_{bias} + V_{signal}) \times \frac{Z_{receiver}}{(Z_{receiver} + R_{ref})}$$

wherein $V_{bias}$ is the voltage supplied by the DC voltage supply 205, $V_{signal}$ is the AC voltage supplied by the sinus generator 101, $Z_{receiver}$ is the receiver impedance to be determined, and $R_{ref}$ is the resistance of the reference resistor 102.

In case the switching circuit 306 is set to the other position, whereby the DC supply voltage supply 205 is coupled directly to output transducer 103, then the voltage $V_{aux}$ at the first measurement point may be expressed as:

$$V_{aux} = V_{signal} \times \frac{Z_{receiver}}{(Z_{receiver} + R_{ref})} + V_{bias} \times \frac{R_{ref}}{(Z_{receiver} + R_{ref})}$$

However, after filtering the DC voltage away, then the measured voltage $V_{aux}$ may in both cases be expressed as:

$$V_{aux} = V_{signal} \times \frac{Z_{receiver}}{(Z_{receiver} + R_{ref})}$$

from which the receiver impedance $Z_{receiver}$ may be obtained.

The controller 408 is adapted to keep track of the analog signals applied by the signal generator 407 and the corresponding digital signals output by the ADC 402. The signal detector 410 captures the digital signal that is provided in response to the analog signal applied by the signal generator 407 and determines the signal level of that digital signal wherefrom the receiver impedance as a function of frequency and as a function of applied DC bias voltage can be obtained using the formulae given above. The determined signal levels are subsequently supplied to the receiver parameter estimator 409.

The receiver parameter estimator 409 derives three receiver parameters: the receiver resistance, the receiver inductance and the receiver force factor at an applied DC bias voltage of zero. Based on these three receiver parameters it is possible to provide a model that can predict the "ideal" receiver membrane displacement, as a function of the signal applied to the receiver, because the receiver may be assumed free of non-linear distortion effects when measuring at an applied DC bias voltage of zero.

Thus the "ideal" behavior of the receiver is construed to mean the behavior at an applied DC bias voltage of zero, which in the following may also be denoted the small signal behavior.

The small signal (i.e. for an applied DC bias voltage of zero) receiver resistance is obviously derived directly from the measured receiver impedance as the impedance value at a first frequency of zero.

The small signal (i.e. for an applied DC bias voltage of zero) receiver inductance is derived from the measured receiver impedance as the impedance value at a second frequency value, that is above a mechanical receiver resonance and that is characterized in that the slope of the curve of the receiver impedance as a function of frequency approaches 20 dB/decade. In variations the second frequency value is selected to be above 5 kHz (or at least above 2 kHz or at least three times the resonance frequency.

The small signal (i.e. for an applied DC bias voltage of zero) receiver force factor is derived from the measured receiver impedance based on the impedance value at a third frequency value that is determined as the resonance frequency that most hearing aid receivers exhibit. In variations the third frequency value is in the range between 500 Hz and 3 kHz.

The measured and derived small signal values of the receiver resistance, inductance and force factor are stored in the receiver parameter estimator 409 and used as parameters in a first model adapted to predict the distortion free membrane displacement as a function of the signal input to the receiver. The measured and derived values of the receiver resistance, inductance and force factor (for a non-zero applied DC bias voltage) are also stored in the receiver parameter estimator 409 and used as parameters in a second model adapted to predict the non-linear membrane displacement as a function of the signal input to the receiver. The receiver inductance and force factor are non-linear in that their values depend on the displacement of the receiver membrane, while the receiver resistance is independent on the receiver membrane displacement.

Generally the physical parameters of the electrical equivalent circuit for a given hearing aid receiver will be readily available. Most hearing aid receiver manufacturers provide these data. Therefore, according to a variation of the present embodiment, it is sufficient to measure the non-linear behavior of the electrical inductance and the force factor in order to provide a model capable of predicting the non-linear membrane displacement of a hearing aid receiver.

However, according to the present embodiment the receiver resistance is also measured because the value may vary significantly due to manufacturing tolerances, ageing, exposure to humidity and heat especially at high output levels.

Furthermore, the inventors have found that it is necessary to measure the non-linear behavior of the inductance and the force factor with regular intervals in order to be able to take appropriate action in case the distortion becomes excessive due to changes in the non-linear behavior of the electrical inductance and the force factor.

Figure 6:
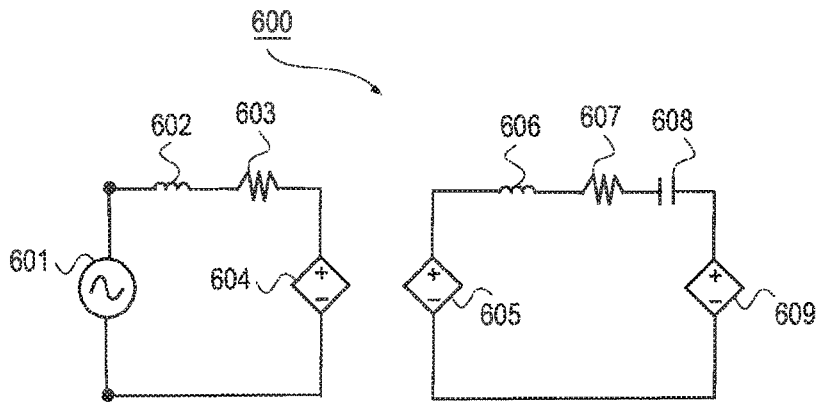
FIG. 6 illustrates an electrical equivalent circuit of an electroacoustic output transducer according to an embodiment of the invention.

Reference is now made to FIG. 6 that shows an electrical equivalent circuit 600 of an electro-dynamic transducer according to an embodiment of the invention. The electrical equivalent circuit is a model capable of predicting the membrane displacement as a function of the signal fed to a hearing aid receiver of the balanced armature type. The electrical equivalent circuit 600 comprises a voltage supply 601 that represents the voltage of the signal that is fed to the receiver, a first resistor 602 that represents the resistance of the receiver, a first inductor 603 that represents the non-linear inductance of the receiver, a first dependent voltage source 604 that represents an induced voltage proportional with the product of the force factor (that may also be denoted transduction coefficient) and the mechanical speed of the receiver armature (that is represented by the current in the right part of the electrical equivalent circuit), a second dependent voltage source 605 that represents an induced voltage proportional with the product of the force factor and the electrical current in the left part of the electrical equivalent circuit, a second inductor 606, a second resistor 607, a capacitor 608 that represents the inverse of the receiver stiffness and a third dependent voltage source 609. Generally the left part of the electrical equivalent circuit represents the electrical part of the balanced armature receiver and the right part of the electrical equivalent circuit represents the mechanical part.

Considering FIG. 6 the electrical receiver impedance $Z_{receiver}$ may be expressed as:

$$Z_{receiver} = R_e + j\omega L_e(x) + \frac{T(x)^2}{Z_m}$$

wherein $R_c$ represents the value of the first resistor 603 of FIG. 6. $L_c(x)$ represents the value of the first inductor 602 of FIG. 6, T(x) represents the force factor, $Z_m$ represents the impedance of the mechanical part (i.e. the right part) of the electrical equivalent circuit of FIG. 6, and the variable x represents the membrane displacement of the receiver.

The impedance $Z_m$ of the mechanical part of the electrical equivalent circuit of FIG. 6 may be expressed as:

$$Z_m = R_m + j\omega L_m + \frac{1}{j\omega C_m}$$

wherein $R_m$ represents the second resistor of FIG. 6, $L_m$ represents the second inductor of FIG. 6, and $C_m$ represents the capacitor of FIG. 6.

It follows directly that the mechanical part of the electrical equivalent circuit of FIG. 6 has an angular resonance frequency $\omega_m$:

$$\omega_m = \frac{1}{\sqrt{L_m C_m}}$$

and consequently it follows that the electrical receiver impedance $Z_{receiver}$ for frequencies sufficiently small may be expressed as:

$$Z_{receiver} = R_e + j\omega(L_e(x) + T(x)^2 C_m) \approx R_e$$

At the mechanical resonance frequency $\omega_m$ the electrical receiver impedance $Z_{receiver}$ may be expressed as:

$$Z_{receiver} = R_e + j\omega L_e(x) + \frac{T(x)^2}{R_m} \approx R_e + \frac{T(x)^2}{R_m}$$

as the impedance due to inductance is small at $\omega_m$.

For frequencies significantly larger than the resonance frequency $\omega_m$:

$$Z_{receiver} = R_e + j\omega L_e(x) + \frac{T(x)^2}{j\omega L_m} \approx R_e + j\omega L_e(x)$$

as the impedance due to the third term $$\frac{T(x)^2}{j\omega L_m}$$

quickly becomes insignificant with increasing frequency.

Thus from the equations given above it follows directly that the non-linear behavior of the force factor T(x) and the electrical inductance $L_e(x)$ may be determined by measuring the electrical receiver impedance at three different frequencies.

It also follows, that since the resistance of the first resistor $R_e$ of FIG. 6 is not non-linear then, in variations, it may be sufficient to use a value of $R_e$ as obtained e.g. from the receiver manufacturer.

According to the present embodiment a DC bias voltage of half the designed maximum receiver voltage is applied, hereby providing that the voltage over the receiver, which is the combination of the bias voltage and the small signal voltage do not exceed the designed maximum receiver voltage. However, in variations a larger bias voltage may be applied and in further variations a multitude of measured values (i.e. for a multitude of non-zero applied DC bias voltages) of the receiver impedance may be obtained to provide a more precise model for predicting the non-linear membrane displacement as a function of the signal input to the receiver.

In a further variation the maximum bias voltage to be applied is found by increasing the magnitude of the bias voltage until the deviation, from the linear situation, of a non-linear parameter or the receiver membrane displacement exceeds a predetermined threshold. This may be done adaptively.

In principle a measurement with a zero applied DC bias voltage together with a single measurement with a non-zero applied DC bias voltage is sufficient to characterize the non-linear behavior of the receiver.

However, by having a measurement with a positive applied DC bias voltage and a measurement with a negative applied DC bias voltage it becomes possible to compensate asymmetrically. This is especially advantageous since the inventors have found that the non-linear behavior of hearing aid receivers with degraded performance is often asymmetrical.

In yet other variations according to the present embodiment, the magnitude of the negative and positive bias voltage is at least 35% of the hearing aid battery voltage.

Obviously the accuracy of the distortion compensation will increase with the number of measurements at different bias voltage levels.

Figure 5:
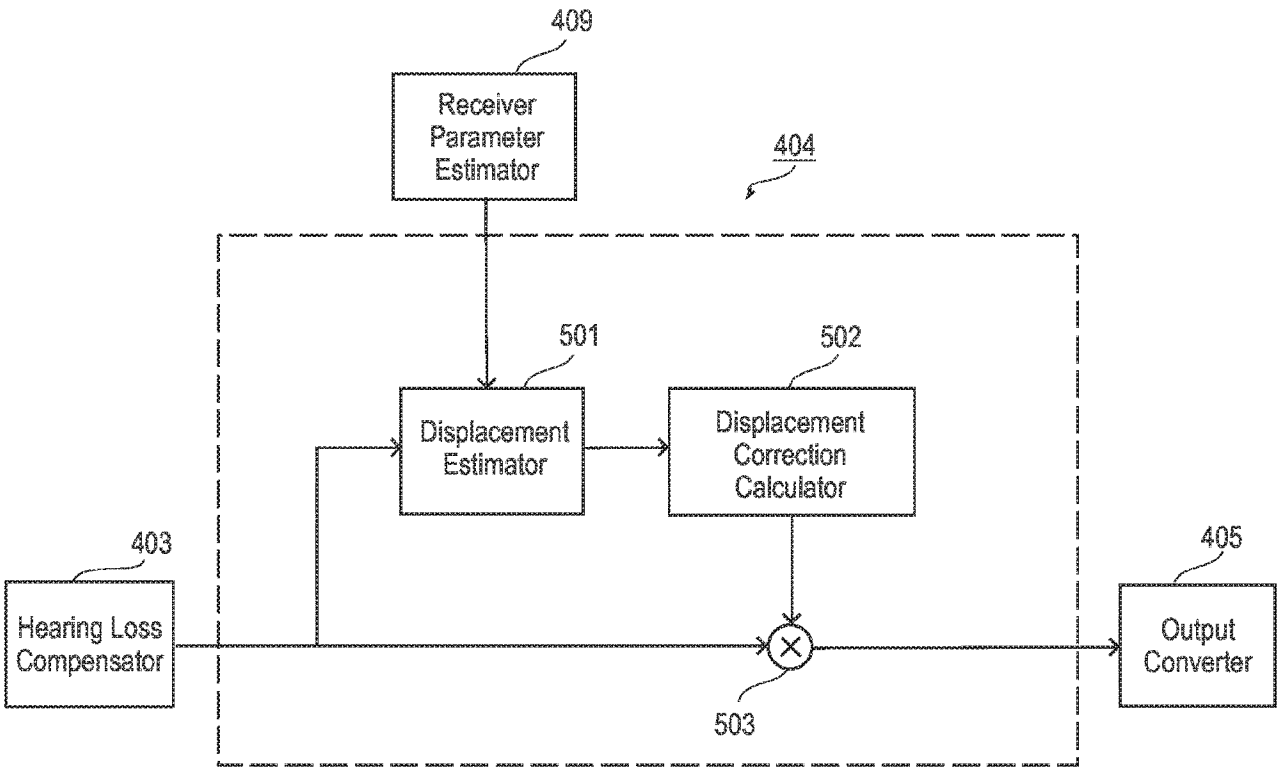
FIG. 5 illustrates highly schematically some additional details of the hearing aid of FIG. 4 according to an embodiment of the invention.

Based on the distortion free first model and the non-linear second model of the receiver membrane displacement a compensation gain can be derived as a function of a given input signal value Reference is now given to FIG. 5, which illustrates highly schematically some additional details of the receiver non-linearity compensator 404 according to an embodiment of the invention.

The non-linearity compensator 404 comprises a displacement estimator 501, a displacement correction calculator 502 and a multiplication unit 503.

The displacement estimator 501 holds the first and second models that are adapted to predict respectively the distortion free receiver membrane displacement (i.e. based on the small signal measurements) and the non-linear receiver membrane displacement as a function of the signal value provided from the hearing loss compensator 403 (for reasons of clarity the signal detector that provides the value of the signal from the hearing loss compensator 403 is not shown). In the following the value of the signal from the hearing loss compensator 403 may also be denoted the processed input signal value, since the output signal from the hearing loss compensator may be denoted the processed input signal. Therefore the displacement estimator 501 is adapted to provide, on a sample by sample basis, the predicted distortion free and non-linear receiver membrane displacements to the displacement correction calculator 502.

According to the present embodiment the displacement correction calculator 502 calculates the compensation gain, on a sample by sample basis, as the ratio of the distortion free displacements over the non-linear displacement and applies, on a sample by sample basis, the compensation gain, using the multiplication unit 503, to the signal provided from the hearing loss compensator 403. Hereby forming a signal that is compensated for non-linearity and that is subsequently provided to the output converter 405 of the hearing aid system 400.

According to a variation of the present embodiment the receiver parameter estimator 409 transmits the measured parameters to an external device, with access to abundant processing resources, whereby a look-up table is calculated using the functionality disclosed above with reference to the displacement estimator 501 and the displacement correction calculator 502, i.e. the look-up table has as input the signal value from the hearing loss compensator 403 and as output the compensation gain to be applied, and subsequently the look-up table is transmitted to the hearing aid and used to determine the compensation gain to be applied. In case a look-up table is used the displacement correction calculator will also include interpolation means such that a compensation gain may be determined also for all input signal values and not just the tabulated values in the look-up table. Thus the basic functionality of deriving the compensation gain to be applied as a function of the signal value from the hearing loss compensator may be accommodated in a hearing aid, in an external device or on an internet server that the external device may access. By placing this functionality outside of the hearing aid fewer hearing aid resources will be required.

According to variations of the present invention the hearing aid receiver distortion compensation, i.e. the application of a compensation gain is activated in response to a trigger condition that may be either manual activation of the hearing aid system, or that a sound level estimate exceeds a predefined threshold, or that a measure of the hearing aid receiver distortion exceeds a predefined threshold.

In variations the displacement estimator 502 calculates ultimately another measure of the sound quality or distortion for the hearing aid receiver than the membrane displacement. Thus instead of estimating the membrane displacement the sound pressure provided by the hearing aid receiver may be estimated. However, within the present context any such measure that can be derived from the membrane displacement will be considered an obvious equivalent and may be used interchangeably with membrane displacement.

In other variations of the present embodiment the displacement correction calculator 502 calculates the compensation gain as a function of the processed input signal value by taking the non-linear receiver behavior into account such that the compensation gain is somewhat larger than the ratio of the distortion free membrane displacement over the distorted non-linear membrane displacement. According to a more specific variation an iterative process uses the non-linear model of the receiver membrane displacement to find the gain compensation that, assuming that the models of the receiver membrane displacement are valid, will fully compensate the non-linear behavior of the hearing aid behavior.

According to another embodiment of the present embodiment the compensation gain as a function of the processed input signal value is determined by: measuring the electrical impedance of the hearing aid receiver at a given frequency and for a multitude of bias voltages including a bias voltage of zero, deriving the compensation gain, based on the difference between the measured electrical impedance across said multitude of bias voltages and the measured electrical impedance at zero bias voltage, hereby providing a less complex method at the cost of a less accurate compensation.

In still another variation of the invention the displacement estimator 501 and the displacement correction calculator 502 comprises a multitude of look-up tables that for a multitude of frequencies provide compensation gains as a function of the values of corresponding band-split signals provided from a hearing loss compensator and wherein the compensation gains are applied to the corresponding band-split signals that are subsequently combined before being provided to the output converter 405. Some of the embodiments of the present invention have been disclosed in connection with specific methods for measuring and deriving receiver parameters. In variations hereof other methods may be applied, thus the receiver distortion compensation methods of the present invention are generally independent on how the receiver impedance is measured.

The various hearing aid functionalities, such as hearing loss compensator 403 and receiver non-linearity compensator 404 may be implemented as separate electronic units or may be integrated in one or several digital signal processors.

Figure 7:
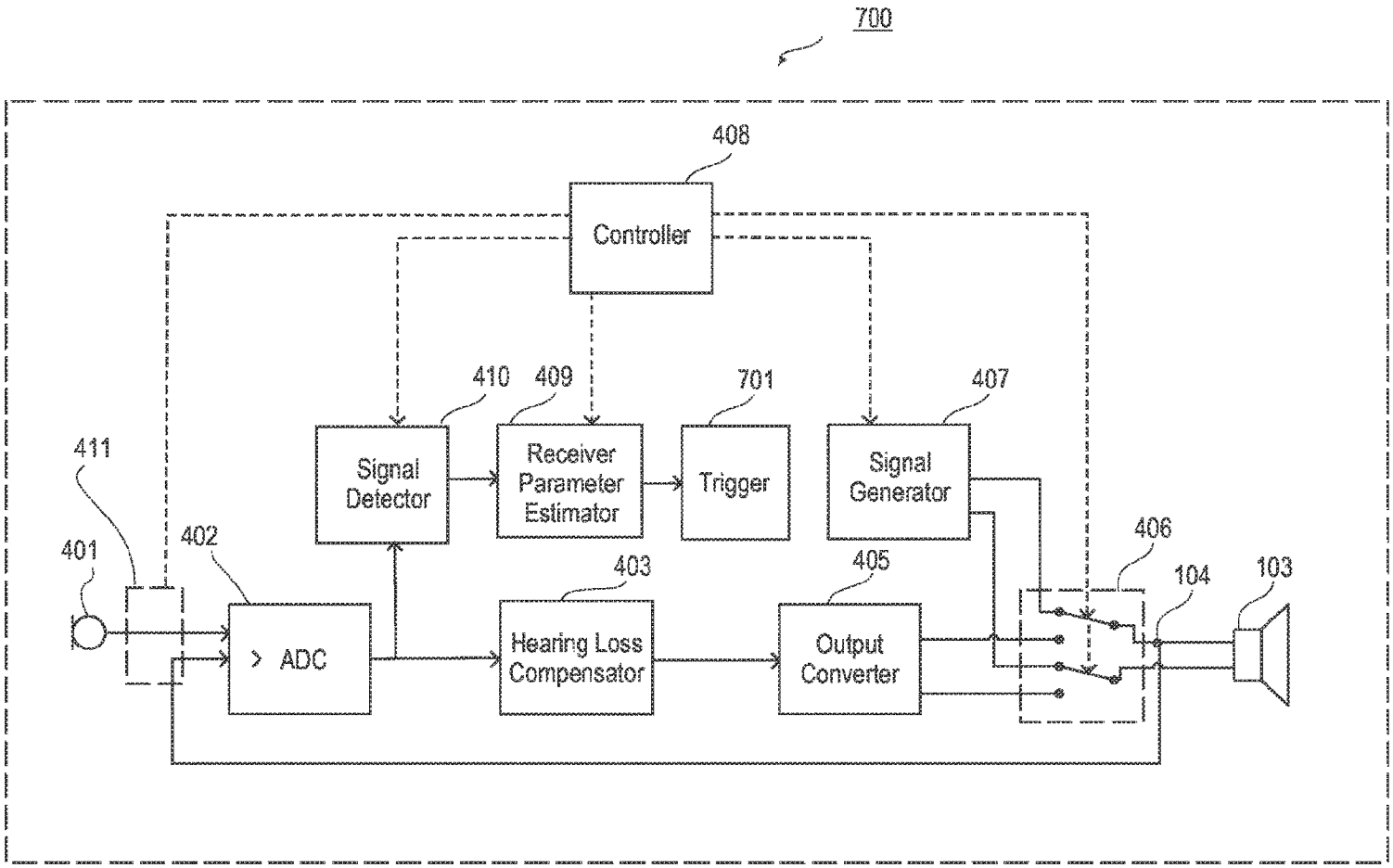
FIG. 7 illustrates a hearing aid according to an embodiment of the invention.

Reference is now made to FIG. 7, which illustrates highly schematically a hearing aid 700 according to an embodiment of the invention. The hearing aid 700 comprises the same components as the circuitry of FIG. 4 except for the removal of the receiver non-linearity compensator 404 and the addition of a trigger 701 that is adapted to determine whether the non-linearity of the hearing aid receiver has exceeded a predetermined threshold based on the determined non-linear behavior of a non-linear hearing aid receiver parameter and adapted to trigger an action directed at alerting a hearing aid system user by providing an acoustic alert. In variations the action may comprise providing a visual alert on an external device of the hearing aid system or may comprise storing information related to the determined non-linearity in the hearing aid system, whereby a hearing care professional at a later point in time can read-out the data and take appropriate action. In a further variation information related to the determined non-linearity may be transmitted to an external server using the external device whereby a hearing care professional may access the data immediately and take appropriate action if necessary.

In further variations the action may be directed at compensating the non-linearity of the hearing aid receiver. Thus the trigger may be adapted to trigger only one or any selected combination of actions if the non-linearity of the hearing aid receiver has exceeded a predetermined threshold based on the determined non-linear behavior of a non-linear hearing aid receiver parameter.

The invention claimed is:

1. A method of operating a hearing aid system comprising the steps of:

measuring the electrical impedance of a hearing aid receiver for a given frequency and for a range of different bias voltages applied to the hearing aid receiver, deriving values of a non-linear hearing aid receiver parameter for the range of different bias voltages, using the derived values of the non-linear hearing aid receiver parameter to estimate a measure of the non-linearity of the hearing aid receiver, triggering an action directed at alerting a hearing aid system user or directed at compensating the non-linearity of the hearing aid receiver if the estimated measure of the non-linearity exceeds a predetermined threshold.

2. The method according to claim 1 comprising the further steps of:

determining a resonance frequency of the electrical impedance of the hearing aid receiver based on the curve shape of the electrical impedance of the hearing aid receiver as a function of frequency, and selecting the resonance frequency as the given frequency, whereby values of the non-linear force factor of the hearing aid receiver may be derived.

3. The method according to claim 1 comprising the further step of:

selecting as the given frequency, a frequency that is above a resonance frequency of the electrical impedance of the hearing aid receiver, whereby values of the electrical non-linear inductance of the hearing aid receiver may be derived.

4. The method according to claim 1, wherein said range of different bias voltages applied to the hearing aid receiver comprises a negative bias voltage and a positive bias voltage.

5. The method according to claim 4, comprising the step of:

using a switch to configure a DC voltage supply such that a positive bias voltage is provided to either the positive or the negative terminal of the hearing aid receiver and hereby providing that either a positive or negative bias voltage is applied to the hearing aid receiver.

6. The method according to claim 1, wherein said measure of the non-linearity is the maximum extent of a range of bias voltage levels within which range, the non-linear hearing aid receiver parameter at said given frequency deviates less than a predetermined value.

7. The method according to claim 1, wherein said measure of the non-linearity is the extent of a symmetric range of positive and negative bias voltage levels within which symmetric range, the non-linear hearing aid receiver parameter at said given frequency deviates less than a predetermined value.

8. The method according to claim 1, wherein said measure of the non-linearity is the deviation of the electrical impedance of the hearing aid receiver, at said given frequency, measured at a predetermined non-zero bias voltage relative to the electrical impedance of the hearing aid receiver, at said given frequency, measured at zero bias voltage.

9. The method according to claim 1, comprising the further steps of:

measuring the electrical impedance of the hearing aid receiver for a multitude of different frequencies and applied bias voltages in response to a first trigger event, deriving updated hearing aid receiver parameters based on said measurements,—using the updated hearing aid receiver parameters to provide an updated estimate of a measure of the non-linearity of the hearing aid receiver.

10. The method according to claim 9, wherein said first trigger event is initiated manually or initiated automatically at predefined time intervals or in response to the hearing aid system being powered up.

11. The method according to claim 9, comprising the further step of switching from a normal mode of operation to a receiver measurement mode in response to said first trigger event, wherein the input signal of the hearing aid system is not fed to an analog-digital converter of the hearing aid system in the receiver measurement mode and whereby the analog-digital converter can be used in the receiver measurement mode.

12. The method according to claim 1, wherein the action directed at alerting a hearing aid system user comprises using the hearing aid system to issue an acoustic alert.

13. The method according to claim 1, wherein the action directed at compensating the non-linearity of the hearing aid receiver comprises the further steps of:

predicting a distorted and non-distorted membrane hearing aid membrane displacement based on derived values of a multitude of non-linear hearing aid receiver parameters for the range of different levels of the bias voltage, determining a processed input signal value, wherein a processed input signal is an input signal that has been processed in order to compensate the hearing loss of a hearing aid system user, deriving a compensation gain, suitable to compensate non-linear receiver distortion, based on the non-distorted predicted membrane displacement and the distorted predicted membrane displacement and the processed input signal value, applying the compensation gain to a processed input signal.

14. A hearing aid system comprising a signal generator adapted to provide a test signal to a receiver of the hearing aid system, wherein the test signal consists of a small signal part and a DC bias voltage, a signal detector adapted to determine the value of a signal representing the receiver impedance, in response to a given test signal,—a hearing aid receiver parameter estimator adapted to determine the non-linear behavior of a non-linear hearing aid receiver parameter, and a trigger adapted to determine whether the non-linearity of the hearing aid receiver has exceeded a predetermined threshold based on the determined non-linear behavior of a non-linear hearing aid receiver parameter and adapted to trigger an action directed at at least one of (i) alerting at least one of a hearing aid system user and hearing care professional, and (ii) compensating the non-linearity of the hearing aid receiver.

* * * * *